US008973517B1

(12) United States Patent
Bort

(10) Patent No.: US 8,973,517 B1
(45) Date of Patent: Mar. 10, 2015

(54) SOLAR POWERED FLAGPOLE

(76) Inventor: Bruce Bort, Lemont, IL (US)

( * ) Notice: Subject to any disclaimer, the term of this patent is extended or adjusted under 35 U.S.C. 154(b) by 718 days.

(21) Appl. No.: 13/108,210

(22) Filed: May 16, 2011

Related U.S. Application Data

(60) Provisional application No. 61/346,580, filed on May 20, 2010.

(51) Int. Cl.
*G09F 17/00* (2006.01)

(52) U.S. Cl.
USPC ..... 116/173; 362/183

(58) Field of Classification Search
CPC . G09F 13/16; G09F 17/00; G09F 2013/0431; G09F 2013/0468; F21S 9/03
USPC ..... 116/173–175, 28 R, 209; 40/602, 40/607.01, 430, 440; 362/183, 431
See application file for complete search history.

(56) References Cited

U.S. PATENT DOCUMENTS

| | | | | | |
|---|---|---|---|---|---|
| 1,171,917 | A * | 2/1916 | Axford | 116/173 |
| 1,256,232 | A * | 2/1918 | Howard | 116/173 |
| 1,878,447 | A * | 9/1932 | Sutphen | 116/173 |
| 4,281,369 | A * | 7/1981 | Batte | 362/183 |
| 5,237,490 | A * | 8/1993 | Ferng | 362/183 |
| 5,657,886 | A * | 8/1997 | Tacchella | 211/105.1 |
| 5,983,825 | A * | 11/1999 | Nowak et al. | 116/173 |
| 6,060,658 | A * | 5/2000 | Yoshida et al. | 136/243 |
| 6,067,013 | A * | 5/2000 | Pejic | 340/539.1 |
| 6,126,303 | A * | 10/2000 | Gross | 362/544 |
| 6,455,767 | B1 | 9/2002 | Muller | |
| 6,955,456 | B2 * | 10/2005 | Schroeder | 362/431 |
| 7,192,168 | B2 * | 3/2007 | Day | 362/431 |
| 7,275,495 | B2 * | 10/2007 | Lawrence et al. | 116/174 |
| 7,585,085 | B1 | 9/2009 | Holman | |
| 8,069,811 | B2 * | 12/2011 | Ciaccia | 116/173 |
| 8,215,807 | B1 * | 7/2012 | Brunesti | 362/431 |
| 8,539,902 | B2 * | 9/2013 | Sanvik | 116/173 |
| 8,839,736 | B2 * | 9/2014 | Bort | 116/173 |
| 2004/0083633 | A1 | 5/2004 | Mueller | |
| 2005/0083693 | A1 * | 4/2005 | Garrett | 362/253 |
| 2007/0089338 | A1 | 4/2007 | Barnhouse et al. | |
| 2007/0220790 | A1 * | 9/2007 | Wagter | 40/218 |
| 2008/0013306 | A1 | 1/2008 | Guilmette | |
| 2008/0123362 | A1 * | 5/2008 | Thorneycroft et al. | 362/558 |
| 2008/0156252 | A1 * | 7/2008 | Al-Tawarh | 116/174 |
| 2011/0139058 | A1 * | 6/2011 | Sanvik | 116/173 |
| 2012/0014104 | A1 * | 1/2012 | Morris et al. | 362/249.06 |
| 2012/0017822 | A1 * | 1/2012 | Bort | 116/173 |
| 2012/0113625 | A1 * | 5/2012 | Werner et al. | 362/183 |
| 2012/0281391 | A1 * | 11/2012 | Bort | 362/183 |
| 2013/0250559 | A1 * | 9/2013 | Hawkins | 362/183 |
| 2013/0265786 | A1 * | 10/2013 | Quinzi et al. | 362/431 |
| 2013/0319316 | A1 * | 12/2013 | Shapiro et al. | 116/173 |
| 2014/0062188 | A1 * | 3/2014 | Watanabe | 307/18 |

FOREIGN PATENT DOCUMENTS

| | | |
|---|---|---|
| JP | 2004207109 | 7/2004 |

* cited by examiner

*Primary Examiner* — R. A. Smith
*Assistant Examiner* — Tania Courson

(57) ABSTRACT

A hollow metal flagpole has apertures spaced along the length thereof. Light fixtures and reflectors are inserted inside the pole to direct light outward through the apertures. The pole is intended to be supported horizontally, or nearly horizontally, with the apertures directed downwardly to thereby illuminate a suspended flag.

12 Claims, 6 Drawing Sheets

SOLAR POWERED FLAGPOLE

The applicant claims priority from his previously filed provisional application filed May 20, 2010 and assigned Ser. No. 61/346,580. The present invention relates to illuminated flagpoles and in particular to a flagpole illuminated from a solar collector at the end of the pole.

BACKGROUND OF THE INVENTION

Homeowners who desire to display the flag frequently employ a pole mounting that extends outward of a vertical wall. The mounting supports a pole that may be either perpendicular to the wall or at an angle with outer end of the pole at a higher elevation than the mounting. Guidelines for showing respect to the United States flag suggest that the flag be lowered at sunset and not raised until sunrise. Alternately, if one wishes to continue to display the flag after sunset, the flag should be illuminated. Raising and lowering the flag on a regular basis can be burdensome for one who wishes to show respect, and therefore it is desirable to provide a simple flagpole that can be easily and inexpensively illuminated after sunset.

BRIEF DESCRIPTION OF THE INVENTION

Briefly, the present invention is embodied in a flagpole consisting of a tubular body having an inner opening, an outer wall, an outer end, and a longitudinal axis. The tubular body has a plurality of spaced-apart apertures therein with the apertures positioned with centers along a single line extending parallel to the longitudinal axis.

Within the inner opening of the tubular body are a plurality of electrically illuminated lighting elements, with each of the electrically illuminated lighting elements positioned adjacent one of the apertures. Also positioned within the tubular body is a rechargeable battery and at the outer end of the tubular body is an adjustably mounted solar energy collector. The solar energy collector is electrically connected to the rechargeable battery, and through a switch to the plurality of lighting elements. By operating the switch, the power from the battery or the solar collector is applied to the illuminating elements. The wiring may also include a light detection device connected to the switch, with the light detection device configured to operate the switch and apply power to the illuminating elements when little or no light is being detected by the light detector and disconnecting power to the illuminating elements when light is detected by the light detector.

In the preferred embodiment, the solar collector is retained in an adjustable mount that allows the detector to be rotated about an axis perpendicular to the longitudinal axis of the tubular body. The mounting that retains the solar collector may also be rotatably mounted at the outer end of the flagpole.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENT

Figure 1:
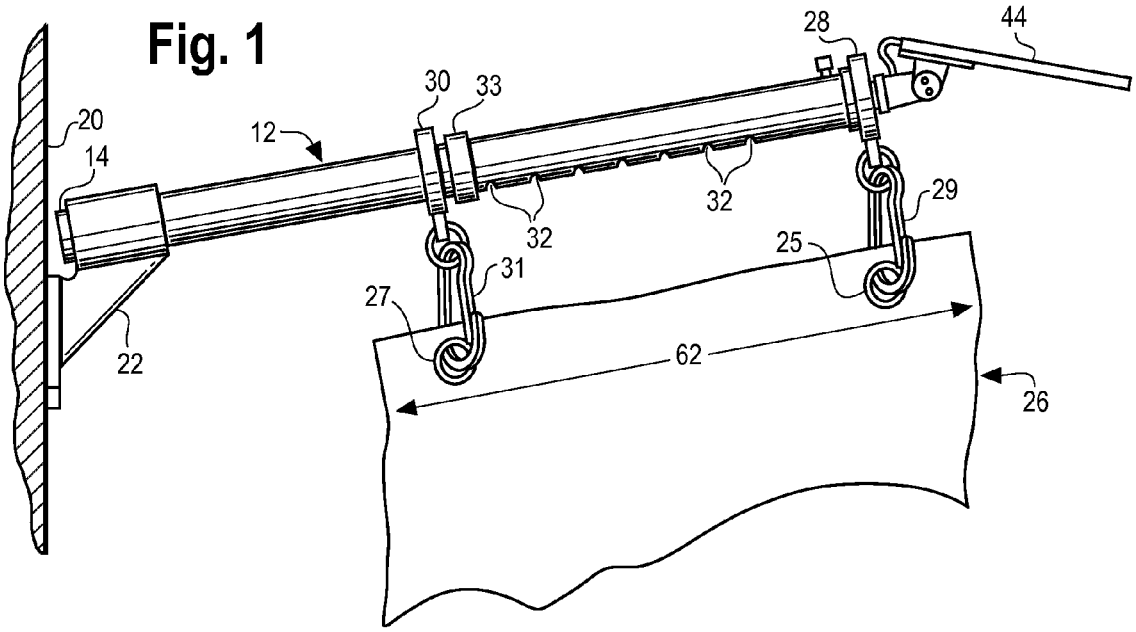
FIG. 1 is a side elevational view of a flagpole in accordance with the present invention with a flag thereon.
Figure 2:
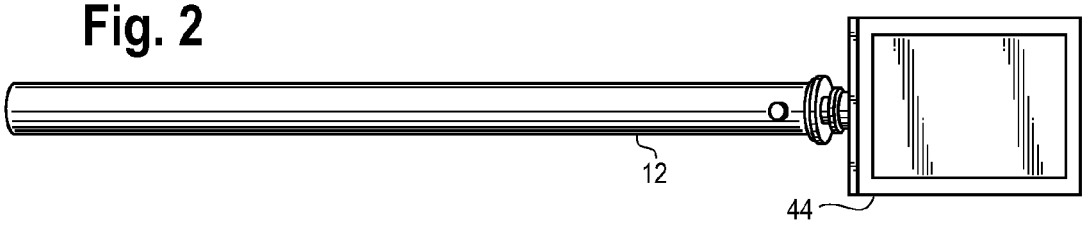
FIG. 2 is a top view of the flagpole shown in FIG. 1.

Referring to FIGS. 1 through 4, a flagpole 10 in accordance with the invention includes a tubular pole body 12 having an inner end 14 and an outer end 16 and a cylindrical inner opening 18. The inner end 14 of the pole body 12 is retained against the wall 20 of a building or the like by a retainer 22 attached to the wall by a plurality of screws, not shown. The retainer 22 can retain the pole so that the longitudinal axis 24 of the pole body 12 is parallel to the ground and perpendicular to the wall 22, or the retainer 22 can support the pole body 12 at a gradual angle as shown, with the outer end 16 of the pole body at a higher elevation that the inner end 14.

Suspended below the pole body 12 is a flag 26, which is retained to the pole body 12 by upper and lower annular connectors 28, 30, each of which extends around the pole body 12 and has a manually operable snap connector 29, 31 attached thereto. The snap connectors 29, 31 can be easily attached to eyes 25, 27 at the ends of a flag 26.

An annular grommet 33 having an opening with a diameter approximately equal to the outer diameter of the pole body 12 is fitted around the pole body 12 immediately outward, or above the lower annular connector 30 to retain the lower connector 30 in a spaced relationship from the upper connector 28. In the preferred embodiment, the annular grommet 33 fits snuggly around the circumference of the pole body 12 so that it will not move as a result of the flapping of the flag or the movement of the air. On the other hand, the grommet 33 should not fit so tightly around the pole body 12 that it cannot be easily manually moved along the length thereof to a desired location. The position of the grommet 33 can therefore be changed as needed thereby enabling the flagpole 10 to accept flags 26 having different widths.

Figure 4:
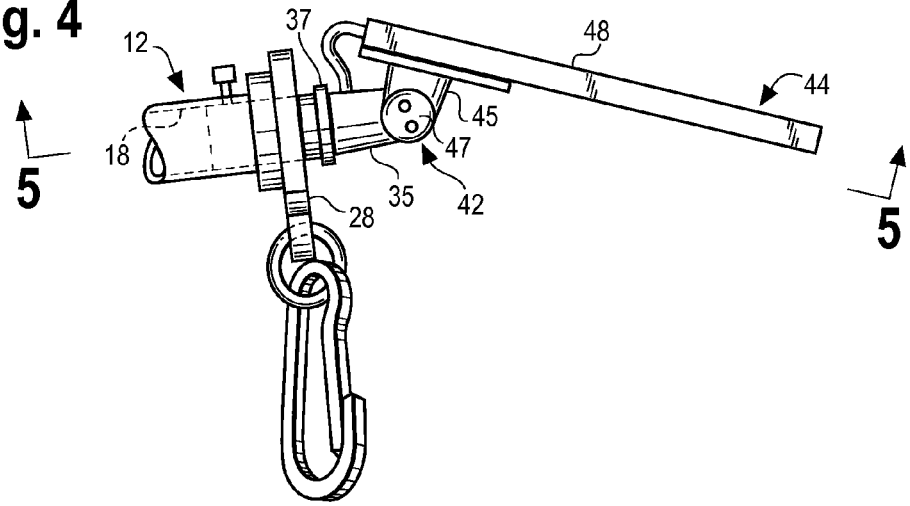
FIG. 4 is an enlarged side view showing the outer end of the flagpole shown in FIG. 1.
Figure 4A:
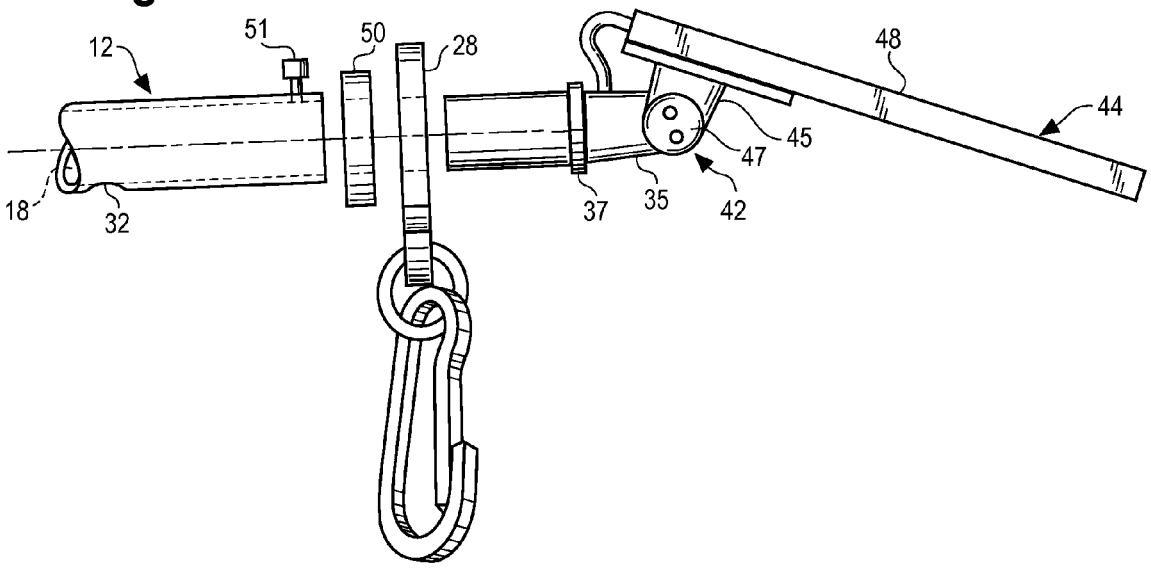
FIG. 4A is an enlarged exploded view of the outer end of the flagpole shown in FIG. 4.
Figure 5:
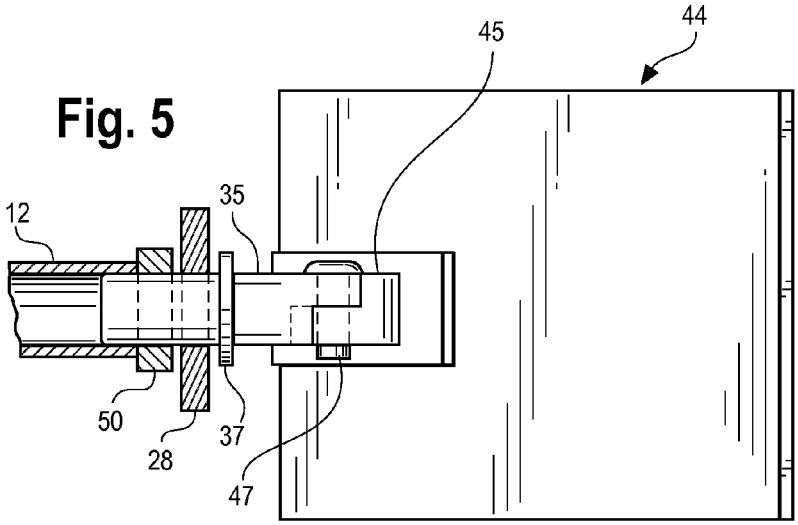
FIG. 5 is an enlarged bottom view of the outer end of the flagpole of FIG. 1.

Referring to FIGS. 4, 4A, and 5, the upper annular connector 28 is preferably rotatably fitted around the circumference of a cylindrical retaining shanks 35 for retaining a pivotal mounting 42 to the end of the pole body 12 for adjustably retaining a solar panel 44 as is further described below. Preferably, the upper annular connector 28 has an inner diameter that is smaller than the outer diameter of the pole body 12 such that it is retained between the distal end of the pole body 12 and an annular flange 45 on the connector 42 as is also described below.

To illuminate the flag 26, the pole body 12 has a plurality of apertures 32-32 therein that extend along a portion of the length of the pole body, with the first aperture 32 positioned near the outer end 16 and the last of the apertures 32 positioned midway along the length of the pole body 12. The first and last apertures 32-32 are spaced a distance from each other that is a little less than the distance between the upper and lower eyes 25, 27 provided on a flag 26. Flags 26 are commonly available with a width of twenty-eight inches or thirty-six inches. In the preferred embodiment of the invention, the first and last apertures are spaced apart by about thirty-three or thirty-four inches and there are six or seven apertures altogether. The apertures 32 are preferably spaced equally distanced apart, with the centers of each of the apertures 32 positioned along a line that extends parallel to the longitudinal axis of the pole body 12. The pole body 12 is positioned with respect to the retainer 22 such that the apertures 32 are all directed generally downwardly, such that light passing through the apertures 32-32 will illuminate the flag 26.

Figure 6:
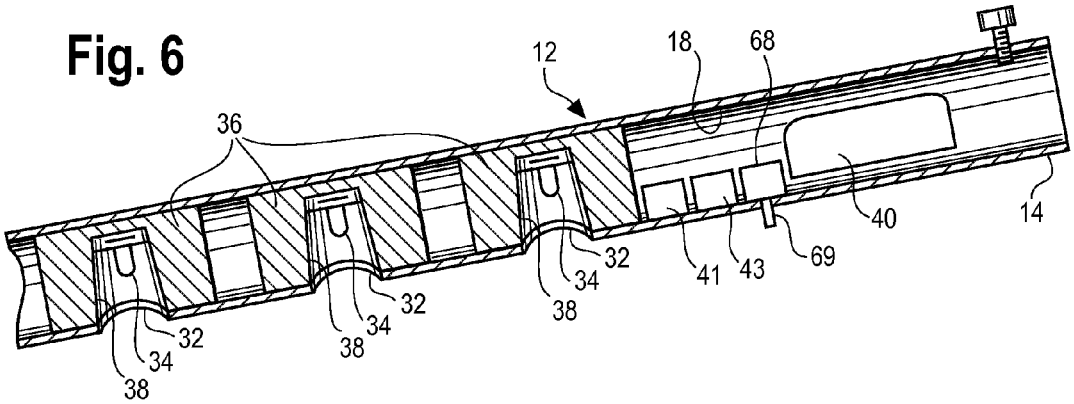
FIG. 6 is a cross-sectional view of the flagpole shown in FIG. 1 with the solar panel and connector removed.

Referring to FIG. 6, within the inner opening 18 of the pole body 12 are a plurality of illuminating elements 34-34, which preferably are LEDs because they draw a relatively low amount of energy for the amount of light produced. The illuminating elements are positioned with one element adjacent each of the apertures 32. Preferably, an elongate reflector 36 having an arcuate reflective inner surface is positioned in the opening 18, with the arcuate surface of the reflector 36 positioned opposite the apertures 32-32 such that light from the illuminating elements 34-34 that is not initially directed outward through the apertures 32-32 will be reflected and ultimately redirected toward the apertures 32-32 thereby maximizing the light through the apertures 32-32. The reflector 36 can be an elongate continuous arcuate shaped reflective member that is slideably received within the inner opening of the pole 12, or the reflectors may be a plurality of contoured members 36 with one member 36 adjacent each illuminating element 34 as shown. Additional small reflective elements 38-38 may be positioned along the length of the reflector 36 and generally perpendicular to the length of the pole body 12 to further direct light through the apertures 32-32.

Figure 17:
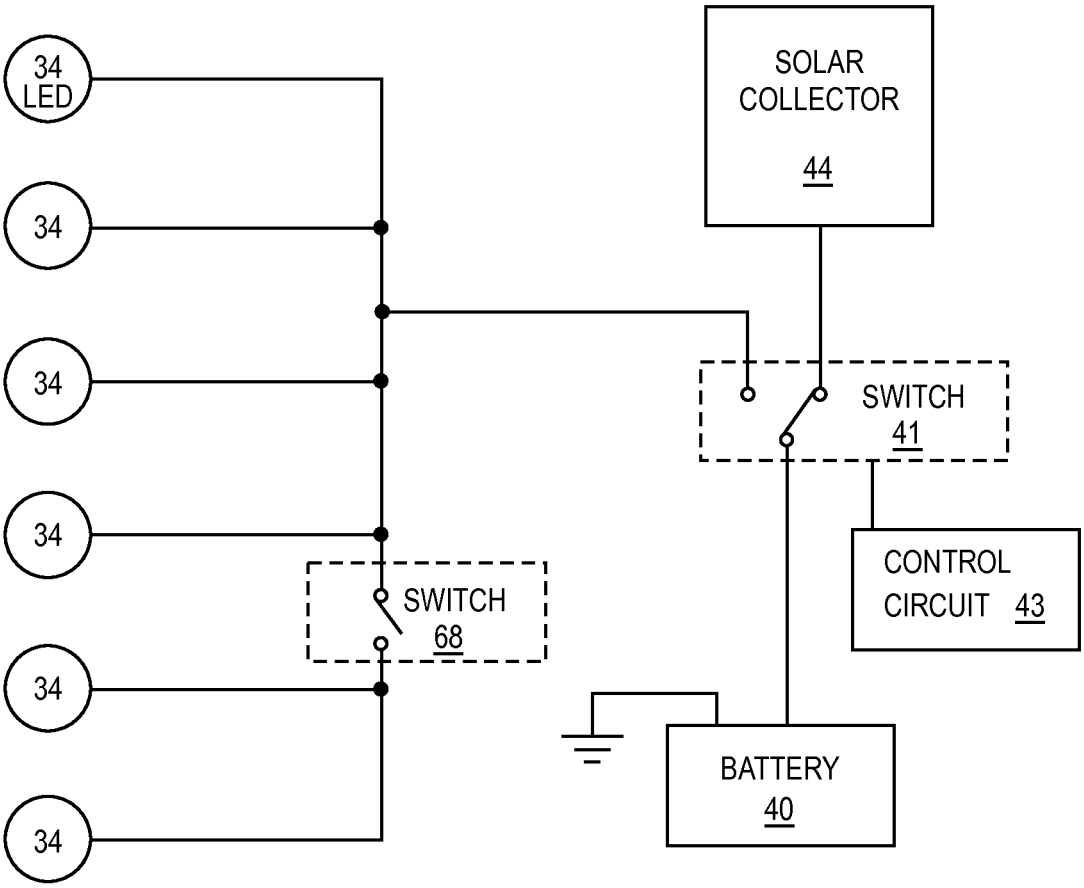
FIG. 17 is an electric circuit for the battery, solar panel, and illuminating elements in the flagpole of the present invention.

As also shown in FIGS. 6 and 17, near the inner end 14 of the flagpole body 12 and inside the inner opening 18 is a rechargeable battery 40. The battery 40 is connected to a double throw switch 41 for alternately connecting the battery 40 to either the illuminating elements 34-34 or the solar panel 44, and the double throw switch 41 is controlled by a control circuit 43. The control circuit 43 measures voltage from the solar panel 44, and if the solar panel 44 is delivering a significant voltage, indicative of daylight, the control circuit 43 operates the switch 41 to connect the battery 40 to the solar panel 44 for charging the battery 40. One the other hand, if the control circuit 43 detects little or no voltage from the solar panel 44, indicative of night, the control circuit 43 will disconnect the solar panel 44, and connect the battery 40 to the illuminating elements 34-34 for illuminating the flag 26.

Referring to FIGS. 4 and 4A, positioned near the outer end 16 of the pole body 12 is the adjustable mounting 42 that pivotally retains the solar panel 44. The mounting 42 includes a bracelet 45 that attaches to the rear surface of the solar panel 44, and attached to the bracket 45 by an adjustable pivot pin 47 is the elongate shank 35. The shank 35 has an outer diameter that is less than the inner diameter of the upper annular connector 28 for rotatably receiving the connector 28. Centrally located on the shank 35 is the annular flange 45 having an outer diameter that is greater than the inner diameter of the connector 28 to prevent the connector 28 from interfering with the pivot pin 47. The distal end of the shank 35 is slideably received into the inner opening 18 of the pole 12 through the outer end 16. The mounting 42 is adjusted with respect to the pole 12 such that the light absorbing surface 48 of the solar panel 44 is directed upwardly while the aperture 32-32 containing the illuminating elements 34-34 are directed downwardly. The parts are retained in their desired orientation by a set screw 51 that extends through a threaded hole, unnumbered, at the end 16 of the pole 12 and abuts the shank 35.

A washer 50 is fitted around the shank 35 between the upper retainer 28 and the end 16 of the pole 12. To assemble the parts, the cylindrical shank 35 is first inserted through the central opening in the upper retainer 28 and then washer 50 and into the outer end 16 of the pole body 12. The shank 35 is inserted into the outer end 16 of the pole body 12 without compressing the retainer 28 between the parts thereby allowing the upper retainer 28 to rotate freely around the shank 35. The set screw 51 then retains the adjustable mounting 42 so that it cannot be rotated with respect to the longitudinal axis 24 of the pole 12.

Figure 3:
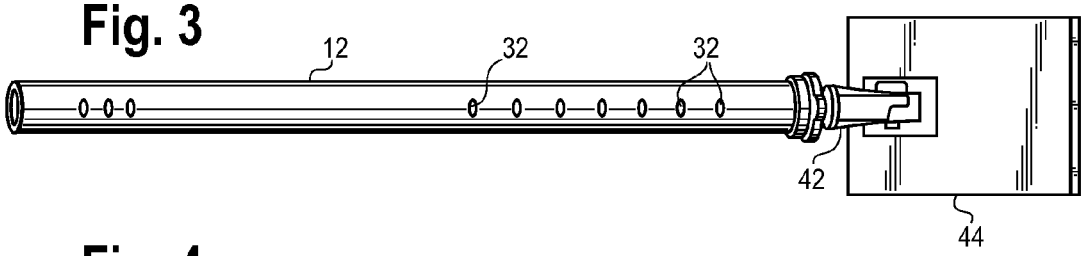
FIG. 3 is the bottom view of the flagpole shown in FIG. 1.
Figure 7:
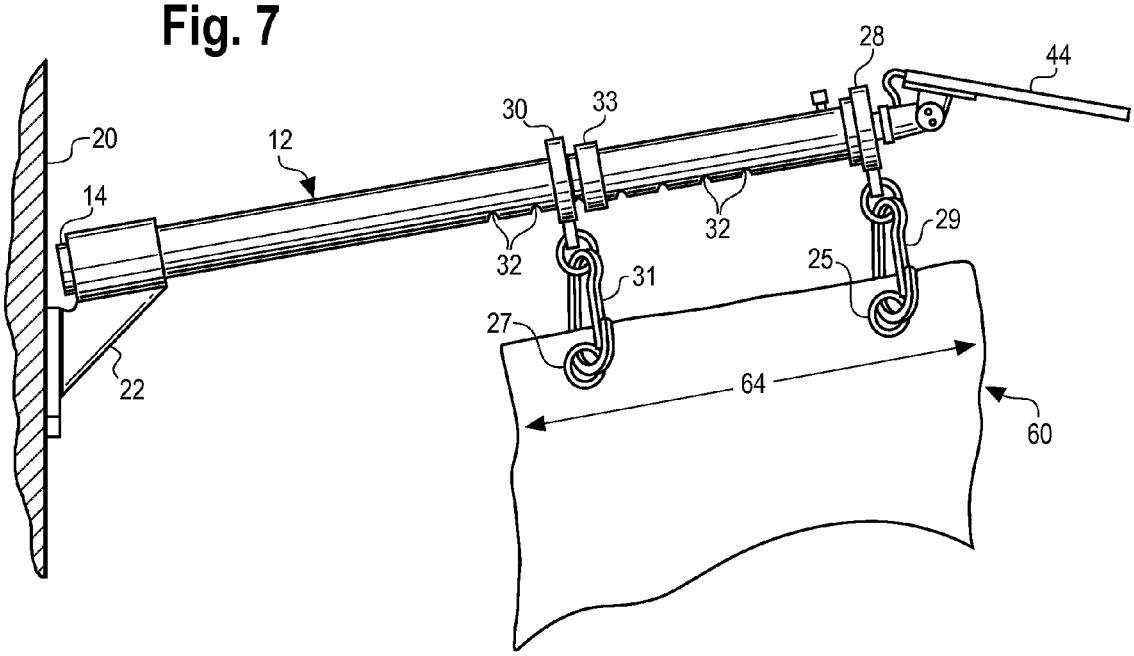
FIG. 7 is another side view of the flagpole shown in FIG. 1, but fitted with a smaller flag.

Referring to FIGS. 1, 6, and 7, in one aspect of the invention, the pole body 12 has a length sufficient to retain a large flag 26 having a large width 62 as shown in FIG. 1, or a smaller flag 60 having a smaller width 64 as shown in FIG. 7. As stated above, flags are typically available with a width of twenty-eight inches or thirty-six inches, and therefore the smaller flag 60 will have a width of twenty-eight inches and the larger flag 26 will have a width of thirty-six inches. The pole body 12 has apertures 32-32 that extend along the pole body sufficient to illuminate the large width 62 of the large flag 26. To illuminate only the smaller flag 64 having a twenty-eight inch width, switch 68 is provided. When the switch 68 is closed, all the illuminating elements 34 for all the apertures 32-32 are connected to the battery 40 and are illuminated, whereas when the switch 68 is open, only the illuminating elements in apertures needed to illuminate the smaller flag 64 are connected to the battery 40. Accordingly, the switch 68 can be used to illuminate only a portion of the illuminating elements. I have found that it is preferable to have six or seven illuminating elements for use with a large flag 62, and only four or five elements to illuminate a smaller flag 64. As shown in FIG. 3, the switch 68 is operable by a thumb slide 69 on the outer surface of the pole 12.

Figure 8:
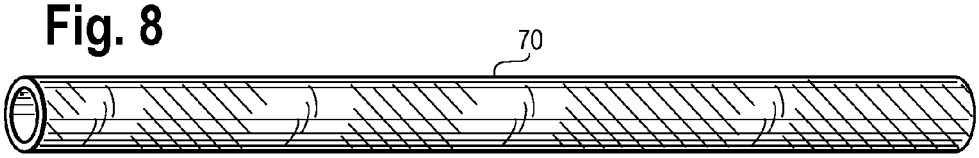
FIG. 8 is a side elevational view of a color tinted sleeve for use with the flagpole shown in FIG. 1.

Referring to FIG. 8, in another embodiment of the invention a color tinted transparent sleeve 70 is provided that can be slipped over the circumference of the tubular body 12 of the flagpole. The tinted sleeve 70 will thereby project light of a desired color through the apertures 32-32 to illuminate a flag 21 attached thereto.

Figure 9:
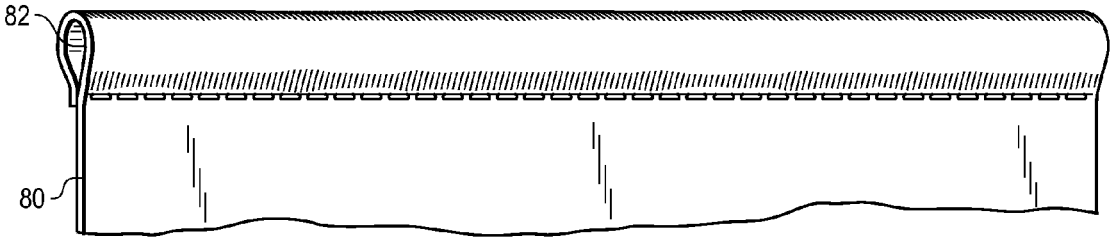
FIG. 9 is a fragmentary isometric view of a flag having a sleeve along one side thereof.
Figure 10:
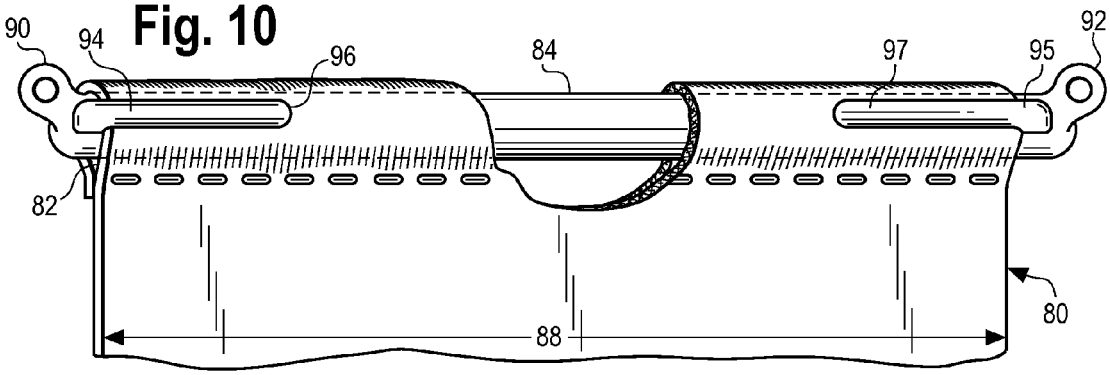
FIG. 10 is a side elevational view of a support pole for retaining the flag of FIG. 7 to the pole of FIG. 1.

Referring to FIGS. 9 and 10, some flags are manufactured with a sleeve along one edge thereof with the sleeve adapted to receive a cylindrical post for mounting of the flag. Such flags do not have upper and lower eyes, such as eyes 25, 27 described with respect to flag 26. Accordingly, a flag 80 having a sleeve 82 that extends along one edge thereof can only be retained by inserting a pole through the sleeve 82. To retain a flag 80 to a flagpole 10 described above, an elongate support pole 84 is provided that has an overall length that is a little longer than the width 88 of the flag 80 such that a portion of the pole 84 will extend out each end of the sleeve 82. A metal eye 90, 92 is provided at each end of the pole 84. To attach the pole 84 to the flagpole 10 the pole 84 is extended through the sleeve 82 and the connectors 29, 31 on the flagpole 10 are attached to the eyes 90, 92 at the end of the pole 84.

The pole 84 may also have spring clips 94 and 95 at each end with the spring clips having compressing ends 96, 97 that are directed towards each other and compress against the surface of the pole 84. An outer end portion of the sleeve 82 is fitted under each of the compressing ends 96, 97 so as to be compressed against the surface of the pole 84 to hold the flag 80 in place.

Figure 11:
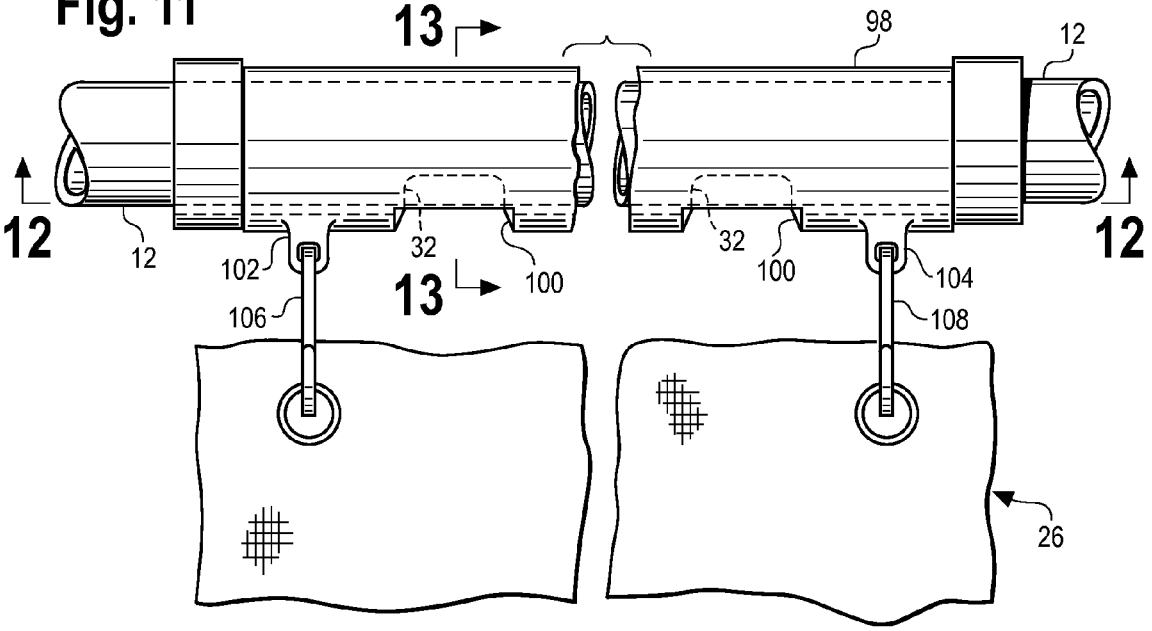
FIG. 11 is a side elevational view of the pole and showing another feature of the invention.
Figure 12:
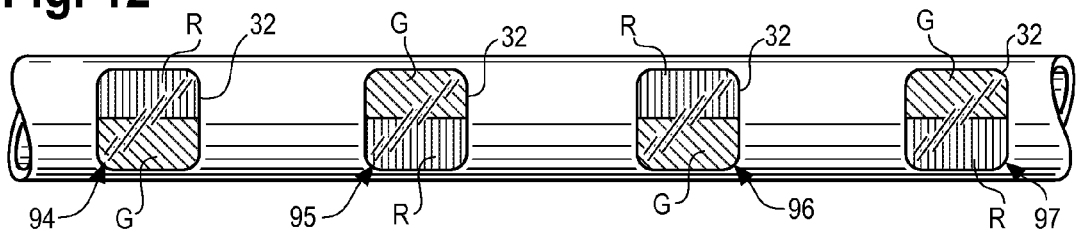
FIG. 12 is a fragmentary bottom view of the embodiment shown in FIG. 11.
Figure 13:
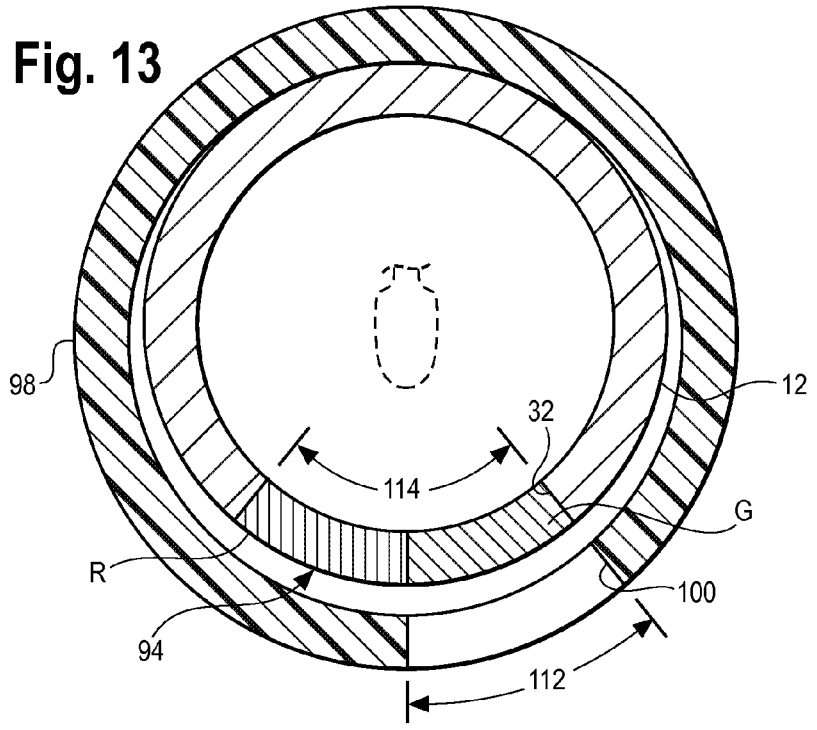
FIG. 13 is a cross-sectional view of the flagpole shown in FIG. 11.

Referring to FIGS. 11, 12, and 13, in another embodiment the apertures 32-32 in the pole body 12 may be circumferentially enlarged, that is extended around a larger portion of the circumference of the pole body with each aperture 32-32 adapted to receive a colored transparent lens, four of which 94, 95, 96, 97 are depicted in FIG. 12. In this embodiment, the colored lenses 94-97 are depicted as having one-half colored red R and the other half colored green G, with every other lens having the red R and green G side reversed (94 and 96 being reversed from 95 and 97) as shown in FIG. 12. Fitted around the pole body 12 is an opaque sleeve 98 having apertures 100-100 spaced linearly along the length thereof so as to align with the apertures 32-32 of the pole body 12. An eye 102, 104 at each end of the sleeve 98 receives a hook 106, 108 for attaching to the eyes of a flag 26. The apertures 100-100 in the sleeve 98 have a circumferential width 112 that is smaller (extends in an arc around a smaller portion of the circumference) than the circumferential width 114 of the apertures 32-32, as best shown in FIG. 13. The inner diameter of the sleeve 98 is a little greater than the outer diameter of the pole body 12 so that the sleeve 98 can easily rotate around the pole body 12. Also, the sleeve 98 is retained near the outer end of the pole body 12 with the aperture 100-100 aligned with the apertures 32-32 of the pole by the grommet 33. Accordingly, wind blowing on the flag 26 will cause the sleeve 98 to rotate a few degrees in each direction around the pole body 12, and as the sleeve 98 rotates from side to side, the smaller apertures 100-100 thereof will alternately align with the red or green tinted lenses 94, 95, 96, 97. The effect will be to change the color of the light directed on the flag 26 as the flag 26 moves in the breeze.

It should be appreciated that while the lenses 94-97 have been described as having one half tinted red and the other half tinted green with the arrangement of colors reversed on every other lens, the lenses may be tinted in any color, and the tinting can be in one, two, three, or any combination of colors without departing from the invention. Similarly, the lenses in each of the apertures may be identical to each other, or every lens may be different from every other lens without departing from the invention.

Figure 14:
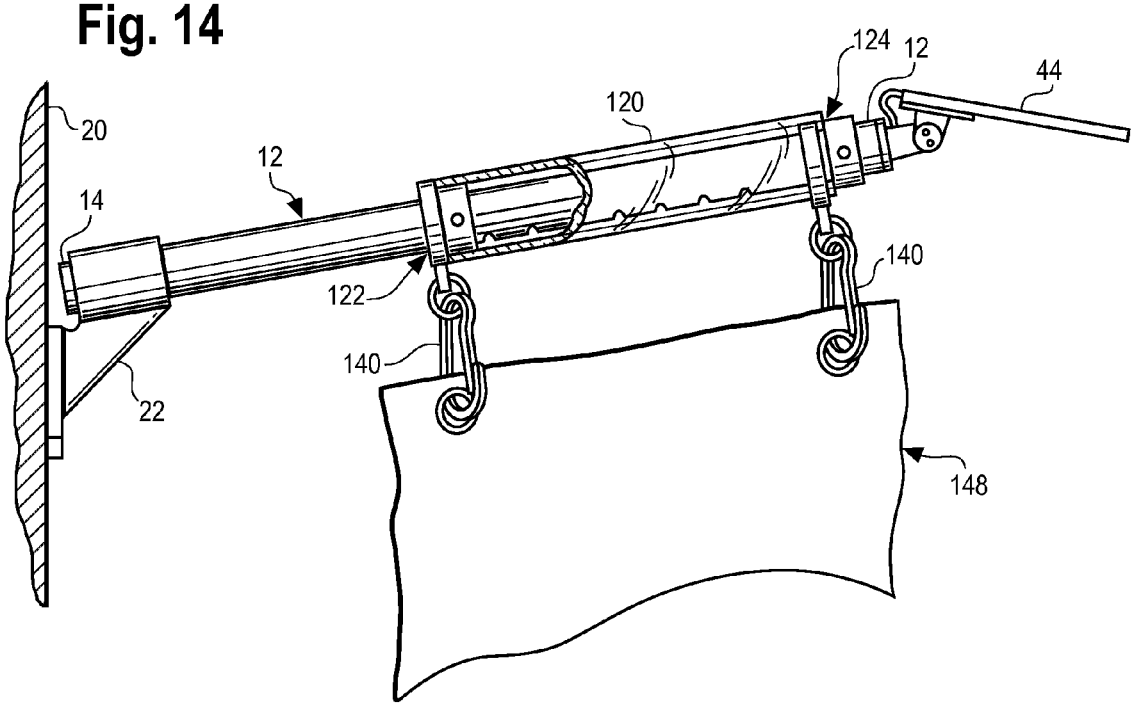
FIG. 14 is a side view of a flagpole with illuminating fixtures therein and a transparent sleeve mounted on the outer race of a bearing for rotation around the pole in accordance with another embodiment of the invention.
Figure 15:
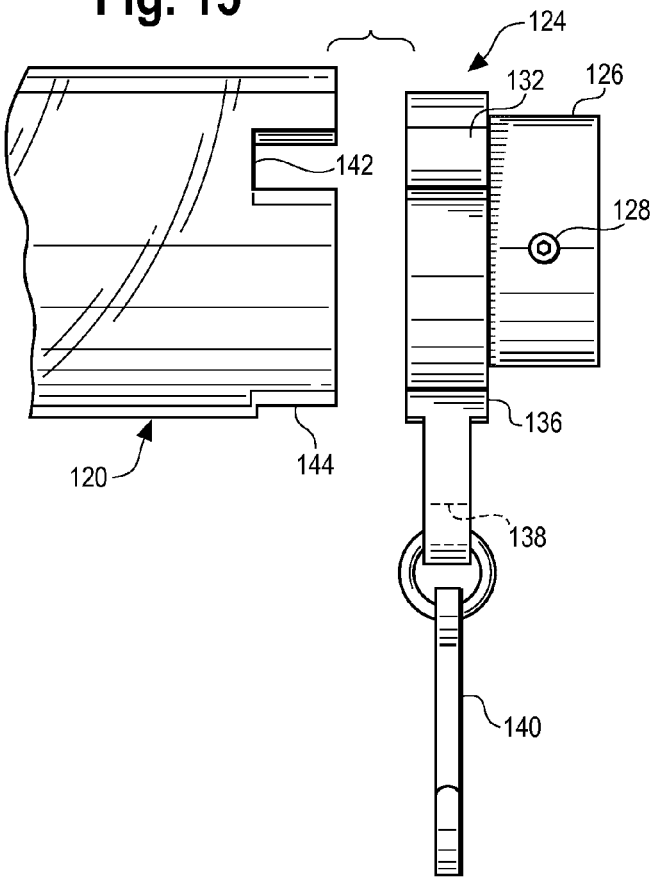
FIG. 15 is an enlarged exploded fragmentary side view showing the attachment of the transparent sleeve to the outer race of one of the bearings shown in FIG. 14.
Figure 16:
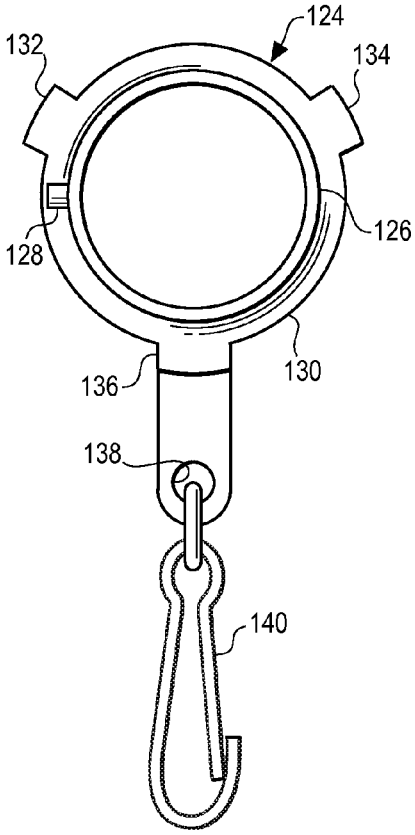
FIG. 16 is an end view of a bearing assembly for retaining a transparent sleeve to the flagpole as shown in FIG. 14.

Referring to FIGS. 14, 15, and 16, in yet another embodiment, a rotatable transparent sleeve 120 is fitted around the circumference of the flagpole 12 with each end of the sleeve 120 retained to a cylindrical race of a bearing 122, 124 where the inner race of each of the bearings 122, 124 has a central opening sized to fit snugly around the outer circumference of the flagpole 12. In this embodiment, bearing assembly 122 is representative of both assemblies 122, 124 and therefore, the description of assembly 122 is applicable to both assemblies 122, 124.

Each bearing assembly 122, 124 includes a stationary inner race 126, the inner diameter of which is sized to receive the flagpole 12. The inner race 126 extends outward of the bearing assembly and includes a set screw 128 that can be tightened against the surface of the flagpole 12 to retain the bearing assembly 122, 124 at its desired position along the length thereof. The bearing assembly 122 also includes a plurality of needle bearings, not shown, that facilitate the rotation of the outer race 130 with respect to the inner race 126. The outer surface of the outer race 130 has a plurality of raised tabs 132,134, 136 thereon, and one of the race tabs 136 includes an eye-hole 138 to which a clip 140 is attachable. Extending between the upper and lower bearing assemblies 122, 124 is the transparent sleeve 120 having an inner diameter that is sized to receive the outer surface of the bearing assemblies 122, 124. Sleeve 120 further has a plurality of notches at each end thereof, two of which 142, 144 are visible in FIG. 15, for fitting around the raised tabs 132, 136, 138 on the outer race 128 to thereby ensure that the sleeve 120 rotates with the outer race of both the upper and lower bearing assemblies 122, 124. A flag 148 is then attached to the clips 140 that extend through the eye-hole 138 on the outer race of each of the bearing assemblies 122, 124. A flagpole having a rotatable transparent sleeve as provided above will be unable to become wrapped around the pole 12 because the weight of the flag 26 will cause the sleeve 120 to rotate and unwind the flag 148.

Figure 18:
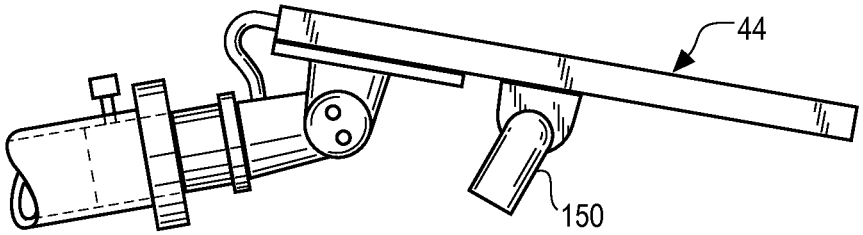
FIG. 18 is a side elevational view of a modified solar collector having a light attached thereto in accordance with another embodiment of the invention.

Referring to FIG. 18 in yet another embodiment of the invention, an additional illuminating member 150 can be attached to the bottom surface of the photoelectric cell 44, with the additional illuminating member 150 directed downwardly and at an angle to further illuminate the flag 26 shown in FIG. 1.

While the present invention has been described with respect to several different embodiments, it will be appreciated that many modifications and variations may be made without departing from the spirit and scope of the invention. It is therefore the intent of the appended claims to cover all such modifications and variations which fall within the spirit and scope of the invention.

What is claimed:

1. A flagpole comprising:

a tubular body having an inner opening, an outer wall, an inner end, an outer end, and a longitudinal axis, said tubular body having said inner end mounted to a vertical structure;

a plurality of spaced apart apertures in said outer wall, said apertures positioned with centers thereof defining a single line extending parallel to said longitudinal axis;

a plurality of electrically illuminated lighting elements in said inner opening;

each of said electrically illuminated lighting elements adjacent one of said apertures;

a solar energy collector at a distal end of said tubular body, and;

an adjustable connector attaching said solar energy collector to said tubular body wherein said solar energy collector can be rotatably adjusted relative to said tubular body to maximize the solar energy collected;

a rechargeable battery attached to said tubular body;

said solar energy collector electrically connected to said battery and said plurality of lighting elements wherein energy from said solar energy collector will recharge said battery and energy from said solar energy collector and said battery will illuminate said lighting elements;

a flag attached to said tubular body having a first eye in an upper corner and a second eye in a lower corner, and;

a first connector rotatable about said tubular body having a clip for attachment to said first eye of said flag, and;

a second connector rotatable about said tubular body having a clip for attachment to said second eye of said flag, and;

said plurality of electrically illuminated lighting elements and plurality of apertures extend parallel to said longitudinal axis of said tubular body and located below said tubular body and extend the distance between the first rotatable connector and the second rotatable connector and said electrically illuminated lighting elements emitting light and illuminating said flag, said flag attached to said first rotatable connector and said second rotatable connector.

2. The flagpole of claim 1 and further comprising at least one electrically illuminated lighting element and at least one aperture and said electrically illuminated lighting element is slideably inserted into said tubular body and said adjustable connector attaching said solar energy collector to said tubular body are secured into their proper position by a set screw.

3. The flagpole of claim 1 and further comprising a color tinted transparent sleeve around said tubular body for coloring light emitted through said apertures.

4. The flagpole of claim 1 and further comprising a reflective member within said tubular body, said reflective member directing light from one said lighting elements out of one of said apertures.

5. The flagpole of claim 1 and further comprising a switch having a first position for illuminating all of said plurality of lights and a second position for illuminating fewer than all of said plurality of lights.

6. The flagpole of claim 1 and further comprising a elongated support pole having an attachment eye at a first end and a second attachment eye at a second end thereof, a first and second connector on said tubular body for connecting to said first and second attachment eyes wherein said pole can be inserted into a sleeve of a flag before attachment of said first and second connector to said first and second eyes, a spring clip adjacent one of said eyes on said elongated support pole for retaining an end of a flag near said eye.

7. The flagpole of claim 1 wherein a colored lens is inserted into one of said apertures for coloring light emitted through said aperture, and wherein said colored lens has one half thereof in one color and the second half thereof a second color that is different form the first color.

8. The flagpole of claim 7 wherein said one of said apertures has a first circumferential width and said flagpole further comprises an opaque sleeve around said tubular body wherein said inner diameter of said opaque sleeve is greater than an outer diameter of said tubular body such that said sleeve is rotatable about said tubular body, said opaque sleeve having an aperture axially aligned with said one of said apertures, said aperture of said opaque sleeve having a second circumferential width that is less than said first circumferential width, and a flag attached to said opaque sleeve wherein said opaque sleeve rotates about said tubular body in response to wind against said flag and wherein rotation of said opaque sleeve changes color of light directed toward said flag.

9. The flagpole of claim 1 and further comprising first and second bearing assemblies on said tubular body, a transparent sleeve around said tubular body, one end of said tubular sleeve connected to an outer race of said first bearing assembly, and a second end of said tubular sleeve connected to an outer race of said second bearing assembly.

10. The flagpole of claim 1 and further comprising an illuminating element on said solar energy collector, and said illuminating element on said solar energy collector directed toward a flag suspended from said tubular body.

11. The flagpole of claim 1 and further comprising a light detector being electrically coupled to a power source and a light emitter, and said light detector closing and opening connection between said light emitter and said power source with the detection of light and absence of light.

12. The flagpole of claim 1 and further comprising wherein the adjustable connector further includes a pivotal mount having a pivot pin to pivotally retain the solar energy collector.

* * * * *